United States Patent [19]

Hoekstra, deceased

[11] 4,415,433

[45] Nov. 15, 1983

[54] FLUID BED RETORTING PROCESS WITH MULTIPLE FEED LINES

[75] Inventor: Gerald B. Hoekstra, deceased, late of South Holland, Ill., by Edith Hoekstra, legal representative

[73] Assignee: Standard Oil Company (Indiana), Chicago, Ill.

[21] Appl. No.: 322,943

[22] Filed: Nov. 19, 1981

[51] Int. Cl.[3] ..... C10G 1/00; C10B 49/10; C10B 53/06

[52] U.S. Cl. ..... 208/11 R; 201/31; 208/8 R

[58] Field of Search ..... 208/8 R, 11 R; 201/31, 201/32

[56] References Cited

U.S. PATENT DOCUMENTS

| | | | |
|---|---|---|---|
| 1,918,162 | 7/1933 | Willson | 201/32 X |
| 2,014,009 | 10/1952 | Matheson | 201/31 X |
| 3,167,494 | 1/1965 | Crawford | 208/11 R |
| 3,454,383 | 7/1969 | Pirsh et al. | 201/31 X |
| 3,852,216 | 12/1974 | Ninomiya et al. | 201/31 X |
| 4,094,767 | 6/1978 | Gifford | 208/11 R |
| 4,133,739 | 1/1979 | Mitchell et al. | 208/11 R X |
| 4,199,432 | 4/1980 | Tamm et al. | 208/11 R X |
| 4,230,557 | 10/1980 | Bertelsen et al. | 208/11 R X |
| 4,366,046 | 12/1982 | Bertelsen et al. | 208/11 R |

FOREIGN PATENT DOCUMENTS

| | | | |
|---|---|---|---|
| 715167 | 9/1954 | United Kingdom | 208/11 R |

*Primary Examiner*—Delbert E. Gantz
*Assistant Examiner*—Glenn A. Caldarola
*Attorney, Agent, or Firm*—Thomas W. Tolpin; William T. McClain; William H. Magidson

[57] ABSTRACT

Solid hydrocarbon-containing material, such as oil shale, coal or tar sand, is fed into a retort through a multiplicity of feed lines to enhance retorting efficiency, throughput and product yield. In the preferred form, larger particles of hydrocarbon-containing material gravitate downwardly through the retort in countercurrent relationship to an upward fluidized stream of smaller particles of hydrocarbon-containing material. This arrangement is especially useful to retort larger particles of hydrocarbon-containing material. One or more streams of intermediate size particles of hydrocarbon-containing material can also be fed into the retort.

14 Claims, 3 Drawing Figures

RAW
OIL SHALE
128
126
122
124
130
112
108
86
96
98
104
100
101
ESP
102
106
85
84
83
94
92
88
90
114
110
82
116
80
120
118

FLUID BED RETORTING PROCESS WITH MULTIPLE FEED LINES

BACKGROUND OF THE INVENTION

This invention relates to a process and system for retorting hydrocarbon-containing material, and more particularly, to a fluid bed process and system for retorting solid, hydrocarbon-containing material such as oil shale, coal and tar sand.

Researchers have now renewed their efforts to find alternate sources of energy and hydrocarbons in view of recent rapid increases in the price of crude oil and natural gas. Much research has been focused on recovering hydrocarbons from solid hydrocarbon-containing material such as oil shale, coal and tar sand by pyrolysis or upon gasification to convert the solid hydrocarbon-containing material into more readily usable gaseous and liquid hydrocarbons.

Vast natural deposits of oil shale found in the United States and elsewhere contain appreciable quantities of organic matter known as "kerogen" which decomposes upon pyrolysis or distillation to yield oil, gases and residual carbon. It has been estimated that an equivalent of 7 trillion barrels of oil are contained in oil shale deposits in the United States with almost sixty percent located in the rich Green River oil shale deposits of Colorado, Utah, and Wyoming. The remainder is contained in the leaner Devonian-Mississippian black shale deposits which underlie most of the eastern part of the United States.

As a result of dwindling supplies of petroleum and natural gas, extensive efforts have been directed to develop retorting processes which will economically produce shale oil on a commercial basis from these vast resources.

Generally, oil shale is a fine-grained sedimentary rock stratified in horizontal layers with a variable richness of kerogen content. Kerogen has limited solubility in ordinary solvents and therefore cannot be recovered by extraction. Upon heating oil shale to a sufficient temperature, the kerogen is thermally decomposed to liberate vapors, mist, and liquid droplets of shale oil and light hydrocarbon gases such as methane, ethane, ethene, propane and propene, as well as other products such as hydrogen, nitrogen, carbon dioxide, carbon monoxide, ammonia, steam and hydrogen sulfide. A carbon residue typically remains on the retorted shale.

Shale oil is not a naturally occurring product, but is formed by the pyrolysis of kerogen in the oil shale. Crude shale oil, sometimes referred to as "retort oil," is the liquid oil product recovered from the liberated effluent of an oil shale retort. Synthetic crude oil (syncrude) is the upgraded oil product resulting from the hydrogenation of crude shale oil.

The process of pyrolyzing the kerogen in oil shale, known as retorting, to form liberated hydrocarbons, can be done in surface retorts in aboveground vessels or in situ retorts underground. In principle, the retorting of shale and other hydrocarbon-containing materials, such as coal and tar sand, comprises heating the solid hydrocarbon-containing material to an elevated temperature and recovering the vapors and liberated effluent. However, as medium grade oil shale yields approximately 20 to 25 gallons of oil per ton of shale, the expense of materials handling is critical to the economic feasibility of a commercial operation.

In order to obtain high thermal efficiency in retorting, carbonate decomposition should be minimized. Colorado Mahogany zone oil shale contains several carbonate minerals which decompose at or near the usual temperature attained when retorting oil shale. Typically, a 28 gallon per ton oil shale will contain about 23% dolomite (a calcium/magnesium carbonate) and about 16% calcite (calcium carbonate), or about 780 pounds of mixed carbonate minerals per ton. Dolomite requires about 500 BTU per pound and calcite about 700 BTU per pound for decomposition, a requirement that would consume about 8% of the combustible matter of the shale if these minerals were allowed to decompose during retorting. Saline sodium carbonate minerals also occur in the Green River formation in certain areas and at certain stratigraphic zones. The choice of a particular retorting method must therefore take into consideration carbonate decomposition as well as raw and spent materials handling expense, product yield and process requirements.

In surface retorting, oil shale is mined from the ground, brought to the surface, crushed and placed in vessels where it is contacted with a hot heat transfer carrier, such as hot spent shale, sand or gases, or mixtures thereof, for heat transfer. The resulting high temperatures cause shale oil to be liberated from the oil shale leaving a retorted, inorganic material and carbonaceous material such as coke. The carbonaceous material can be burned by contact with oxygen at oxidation temperatures to recover heat and to form a spent oil shale relatively free of carbon. Spent oil shale which has been depleted in carbonaceous material is removed from the retort and recycled as heat carrier material or discarded. The liberated hydrocarbons and combustion gases are dedusted in cyclones, electrostatic precipitators, filters, scrubbers or pebble beds.

Some well-known processes of surface retorting are: N-T-U (Dundas Howes retort), Kiviter (Russian), Petrosix (Brazilian), Lurgi-Ruhrgas (German), Tosco II, Galoter (Russian), Paraho, Koppers-Totzek, Fushum (Manchuria), Union rock pump, gas combustion and fluid bed. Process heat requirements for surface retorting processes may be supplied either directly or indirectly.

The Lurgi-Ruhrgas process and modifications thereof are described in U.S. Pat. Nos. 3,655,518; 3,703,442; 3,962,043; 4,038,045; and 4,054,492 and in the articles by Marnell, P., entitled *Lurgi/Ruhrgas Shale Oil Process,* published in Hydrocarbon Processing, pages 269–271 (September 1976); Schmalfeld, I. P., *The Use of the Lurgi-Ruhrgas Process for the Distillation of Oil Shale,* Volume 70, Number 3, Quarterly of the Colorado School of Mines, pages 129–145 (July 1975); Rammler, R. W., *The Retorting of Coal, Oil Shale, and Tar Sand by Means of Circulated Fine-Grained Heat Carriers as a Preliminary Stage in the Production of Synthetic Crude Oil,* Volume 65, Number 4, Quarterly of the Colorado School of Mines, pages 141–167 (October 1970) and at pages 81–85 of the *Synthetic Fuels Data Handbook* by Cameron Engineers, Inc. (Second Edition 1978).

The Tosco II process and modifications thereof are described in U.S. Pat. Nos. 3,008,894, 3,034,979; and 3,058,903 and at pages 85–88 of the *Synthetic Fuels Data Handbook.*

The Union rock pump retorting process is described in U.S. Pat. Nos. 2,501,153; 2,640,019; 2,875,137; 2,881,117; 2,892,758; 2,954,328; 2,966,446; 2,989,442; 3,004,898, 3,039,939; 3,058,904; 4,003,797; 4,043,897;

and 4,162,960 and at pages 95–100 of the *Synthetic Fuels Data Handbook.*

The gas combustion retorting process is described at pages 74–76 of the *Synthetic Fuels Data Handbook.*

Directly heated surface retorting processes, such as the N-T-U, Kiviter, Fusham and gas combustion processes, rely upon the combustion of fuel, such as recycled gas or residual carbon in the spent shale, with air or oxygen within the bed of shale in the retort to provide sufficient heat for retorting. Directly heated surface retorting processes usually result in lower product yields due to unavoidable combustion of some of the products and dilution of the product stream with the products of combustion. The Fusham process is shown and described at pages 101–102, in the book *Oil Shales and Shale Oils,* by H. S. Bell, published by D. Van Norstrand Company (1948). The other processes are shown and described in the *Synthetic Fuels Data Handbook,* by Cameron Engineers, Inc. (Second Edition, 1978).

Indirectly heated surface retorting processes, such as the Petrosix, Lurgi-Ruhrgas, Tosco II and Galoter processes, utilize a separate furnace for heating solid or gaseous heat-carrying material which is injected, while hot, into the shale in the retort to provide sufficient heat for retorting. In the Lurgi-Ruhrgas process and some other indirect heating processes, raw oil shale or tar sand and a hot heat carrier, such as spent shale or sand, are mechanically mixed and retorted in a screw conveyor. Such mechanical mixing often results in high temperature zones conducive to undesirable thermal cracking as well as causing low temperature zones which result in incomplete retorting. Generally, indirect heating surface retorting processes result in higher yields and less dilution of the retorting product than directly heated surface retorting processes, but at the expense of additional materials handling.

Surface retorting processes with a moving bed are typified by the Lurgi coal gasification process in which crushed coal is fed into the top of a moving bed gasification zone and an upflowing steam endothermically reacts with the coal. A portion of the char combusts with oxygen below the gasification reaction zone to supply the required endothermic heat of reaction.

Surface retorting processes with entrained beds are typified by the Koppers-Totzek coal process in which coal is dried, finely pulverized and injected into a treatment zone along with steam and oxygen. The coal is rapidly partially combusted, gasified, and entrained by the hot gases. Residence time of the coal in the reaction zone is only a few seconds. Entrained bed processes ae disadvantageous because they require large quantities of hot gases to rapidly heat the solids and often require the raw feed material to be finely pulverized before processing.

Fluid bed surface retorting processes are particularly advantageous. The use of fluidized-bed contacting zones has long been known in the art and has been widely used in fluid catalytic cracking of hydrocarbons. When a fluid is passed at a sufficient velocity upwardly through a contacting zone containing a bed of subdivided solids, the bed expands and the particles are buoyed and supported by the drag forces caused by the fluid passing through the interstices among the particles. The superficial vertical velocity of the fluid in the contacting zone at which the fluid begins to support the solids is known as the "minimum fluidization velocity." The velocity of the fluid at which the solid becomes entrained in the fluid is known as the "terminal velocity" or "entrainment velocity." Between the minimum fluidization velocity and the terminal velocity, the bed of solids is in a fluidized state and it exhibits the appearance and some of the characteristics of a boiling liquid. Because of the quasi-fluid or liquid-like state of the solids, there is typically a rapid overall circulation of all the solids throughout the entire bed with substantially complete mixing, as in a stirred-tank reaction system.

Typifying those prior art fluidized bed retorting processes, fluid catalytic cracking processes, transfer line processes and similar processes are the Union Carbide/-Battelle coal gasification process, the fluid coker and flexicoking processes described at page 300 of the *Synthetic Fuels Data Handbook,* by Cameron Engineers, Inc. (Second Edition, 1978) and those found in U.S. Pat. Nos. 2,471,119; 2,506,307; 2,518,693; 2,608,526; 2,657,124; 2,626,234; 2,634,233; 2,643,218; 2,643,219; 2,684,931; 2,793,104; 2,799,359; 2,807,571; 2,844,525; 3,039,955; 3,152,245; 3,281,349; 3,297,562; 3,499,834; 3,501,394; 3,617,468; 3,663,421; 3,703,052; 3,803,021; 3,803,022; 3,855,070; 3,867,110; 3,890,111; 3,891,402; 3,976,558; 3,980,439; 4,052,172; 4,064,018; 4,087,347; 4,110,193; 4,125,453; 4,133,739; 4,137,053; 4,141,794; 4,148,710; 4,152,245; 4,157,245; 4,183,800; 4,199,432; and 4,247,987. These prior art processes have met with varying degrees of success.

A problem with many prior art fluidized bed processes is the long residence time at high temperatures which results in many secondary and undesirable side reactions such as thermal cracking, which usually increases the production of less desirable gaseous products and decreases the yield and quality of desirable condensable products. Therefore, in any process designed to produce the maximum yield of high quality condensable hydrocarbons, it is preferred that the volatilized hydrocarbons are quickly removed from the retorting vessel in order to minimize deleterious side reactions such as thermal cracking.

To date, none of these prior art systems have provided an effective process to retort large particles of oil shale and other solid hydrocarbon-containing material.

It is therefore desirable to provide an improved retorting process which overcomes most, if not all, of the preceding problems.

SUMMARY OF THE INVENTION

A retorting process is provided in which solid hydrocarbon-containing material, such as oil shale, coal or tar sand, is crushed and separated into different particle sizes and fed into a retort through multiple feed lines. In the preferred form, each of the feed lines contains a different range of particle sizes.

The novel process permits retorting of large hydrocarbon particles, enhances retorting capacity, enlarges throughput and increases product yield. The process is efficient, effective and economical.

While the inventive process is preferably carried out in an upright fluid bed retort or transfer line retort, it can also be carried out in horizontal retorts, inclined retorts, screw conveyor retorts, rock pump retorts and rotating pyrolysis drum retorts.

In the process, large particles of hydrocarbon-containing material are fed into the retort either countercurrently and downstream of smaller particles of hydrocarbon-containing material, or concurrently and upstream of the smaller particles. The novel process gives larger particles more residence time in the retort than smaller paticles, which permits the larger particles to be effectively retorted without substantially thermal cracking the valuable hydrocarbons liberated from the smaller particles.

In the retort, the solid hydrocarbon-containing material is contacted with hot heat carrier material, preferably solid heat carrier material, such as spent hydrocarbon particles, at a temperature greater than the minimum retorting temperature of the solid hydrocarbon-containing material, to heat and retort the solid hydrocarbon-containing material. Hot inert fluidizing gases, such as hot combustion gases, or other solid heat carrier material, such as sand or ceramic or metal balls, can also be used as or form part of the heat carrier material.

In the preferred form, smaller raw and spent particles of hydrocarbon-containing material are fed and mixed in the bottom portion of a fluid bed retort. A fluidizing lift gas is injected into the bottom of the retort to fluidize, entrain and transport the smaller particles upwardly through the retort. Larger particles of hydrocarbon-containing material are fed into the top portion of the retort and gravitate downwardly in countercurrent relationship to the smaller particles.

The larger particles are hindered from quickly falling to the bottom of the retort by the upwardly flowing, fluidized stream of smaller particles. The larger particles, therefore, take more time to reach the bottom of the retort than it takes for the faster moving smaller particles to reach the top of the retort. The rate of descent of the larger particles is controlled by the pressure and flow rate of the lift gas. One or more streams of intermediate size particles of hydrocarbon-containing material can also be fed into the retort through separate feed lines.

The fluidizing lift gas in the retort is an inert gas, such as recycled light hydrocarbon gases which have been separated from the liberated hydrocarbons, or off gases emitted during combustion of the retorted particles in a combustor lift pipe. An oxygen-containing, combustion-sustaining, lift gas such as air, oxygen, oxygen diluted with steam or oxygen diluted with carbon dioxide, is injected into the combustor lift pipe to fluidize and combust smaller retorted particles. Larger retorted particles can also be combusted in the lift pipe in transverse, concurrent or countercurrent flow to the smaller particles.

As used throughout this application, the terms "retorted" hydrocarbon-containing material, "retorted" particles or "retorted" shale refer to hydrocarbon-containing material, particles or oil shale, respectively, which have been retorted to liberate hydrocarbons leaving a material containing carbon residue or coke.

The terms "spent" hydrocarbon-containing material, "spent" particles or "spent" shale as used herein means retorted hydrocarbon-containing material, particles or shale, respectively, from which essentially all of the carbon residue or coke has been removed by combustion.

The term "inert gas" means a gas having less than a sufficient amount of molecular oxygen to sustain combustion.

The term "hydrocarbon" particles means particles containing solid hydrocarbon-containing material.

A more detailed explanation of the invention is provided in the following description and appended claims taken in conjunction with the accompanying drawings.

DETAILED DESCRIPTION OF THE PREFERRED EMBODIMENT

Figure 1:
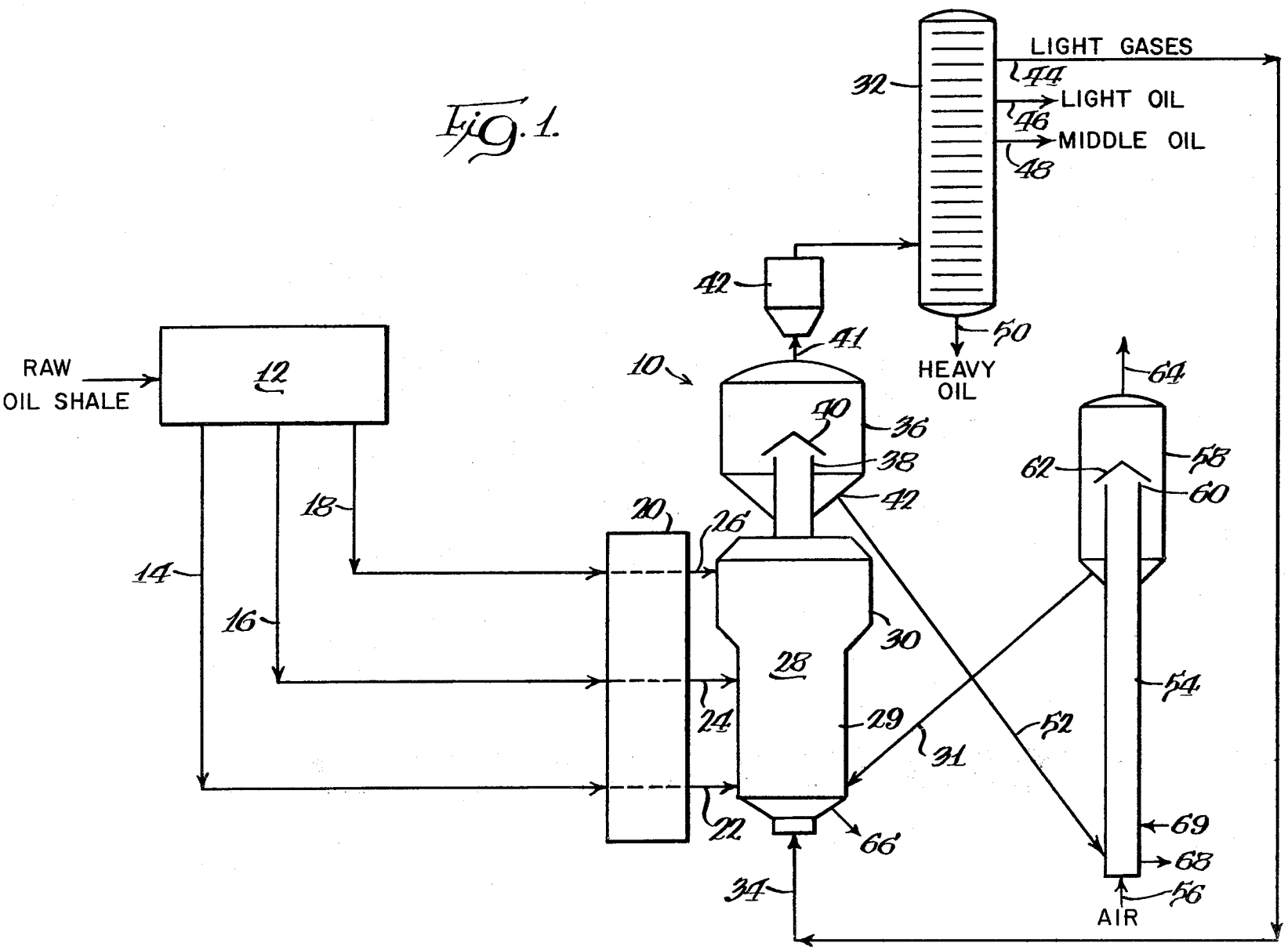
FIG. 1 is a schematic flow diagram of a fluid bed retorting system for carrying out a process in accordance with principles of the present invention.

Referring now to FIG. 1, a fluid bed process and system 10 is provided to retort hydrocarbon-containing material, such as oil shale, coal, tar sand, uintaite (gilsonite), lignite and peat, for use in making synthetic fuels. While the process of the present invention is described hereinafter with particular reference to the processing of oil shale, it will be apparent that the process can also be used to retort other hydrocarbon-containing materials such as coal, tar sand, uintaite (gilsonite), lignite, peat, etc.

In process and system 10, raw oil shale is fed to a crushing and screening station 12. The oil shale should contain an oil yield of at least 15 gallons per ton of shale particles in order to make the process and system self-sustaining in terms of energy requirements, so that the lift gas can consist essentially of liberated light hydrocarbon gases or combustion gases from the system and the heat carrier material can consist essentially of spent oil shale from the system.

At the crushing and screening station 12, raw oil shale is crushed, sized and sorted by conventional crushing equipment such as an impact crusher, jaw crusher, gyratory crusher or roll crusher and by conventional screening equipment such as a shaker screen or vibrating screen into multiple feed lines or streams 14, 16 and 18 of oil shale. In the preferred embodiment, there are three feed lines including a small size oil shale feed line 14, a middle or intermediate size oil shale feed line 16 and a large size oil shale feed line 18.

Small size oil shale feed line 14 contains smaller raw oil shale particles ranging in size from at least one micron to less than 200 microns. Middle size oil shale feed line 16 contains intermediate or middle size raw oil shale particles ranging in size from at least 200 microns to less than 2 mm. Large size oil shale feed line 18 contains larger raw oil shale particles ranging in size from at least 2 mm to less than 10 mm and preferably less than 6 mm.

Oil shale particles less than one micron should be avoided because fine particles of that size tend to clog up the retort and hinder retorting. Oil shale particles greater than 10 mm adversely effect fluidizing and retorting of smaller oil shale particles. Oil shale particles greater than 6 mm are not efficiently retorted in the retort without internals. Oil shale particles over 3 mm cannot generally be fluidized in the retort. In some circumstances, it may be desirable to have more than three feed lines or as few as two feed lines. Furthermore, while the feed lines in the preferred embodiment each contain the above ranges of particle sizes, in some circumstances it may be desirable to have overlapping ranges or some other ranges of particle sizes.

The crushed oil shale particles in feed lines 14, 16 and 18 are conveyed to a preheating station 20 where the shale is preheated to between ambient temperature and 700° F. to dry off most of the moisture contained in the shale. Preferably, the crushed oil shale particles are preheated to a temperature from 250° F. to 600° F., and most preferably, from 300° F. to 400° F. to enhance efficiency of retorting. Oil shale temperatures over 700° F. should be avoided at this stage because they may cause premature retorting. The preheating station 20 and the crushing and screening station 12 can be combined if desired.

The preheated, crushed oil shale particles are conveyed from preheating station 20 through preheated oil shale feed lines or streams 22, 24 and 26, respectively, by a screw conveyor or other conveying means such as a lift elevator, gravity flow or conventional fluid conveying means, into a generally upright fluid bed retort 28, which is sometimes referred to as a "fluidized bed" retort or a "transfer line" retort.

In the illustrative embodiment, the small size preheated oil shale ranging in size at least one micron to less than 200 microns is fed from through preheated small size oil shale feed line 22 into the bottom portion 29 of retort 28. Middle size preheated oil shale ranging in size from at least 200 microns to less than 2 mm is fed through preheated middle size oil shale feed line 24 into the middle or central portion of retort 28. Large size preheated oil shale ranging in size from at least 2 mm to less than 10 mm, and preferably less than 6 mm, is fed through preheated large size oil shale feed line 26 into the upper portion or top 30 of retort 28. In the illustrated embodiment the upper portion 30 of retort 28 has about twice the horizontal cross-sectional area of the lower portion 29 of the retort. In some circumstances it may be advantageous to feed the smaller oil shale particles into the middle of the retort and the intermediate size oil shale particles into the bottom of the retort.

The crushed oil shale particles are fed into retort 28 at a solids flux flow rate between 5,000 and 100,000 lbs/ft$^2$ hr, and preferably between 10,000 and 50,000 lbs/ft$^2$ hr for best results. A solids flux flow rate over 100,000 lbs/ft$^2$ hr, should be avoided because retorting efficiency is reduced.

Heat carrier material, preferably, spent oil shale which originated from lines 22 and 24 having a maximum fluidizable particle size of 3 mm is fed through a heat carrier line 31 into the bottom portion 29 of retort 28 at a temperature from 1000° F. to 1400° F., preferably from 1100° F. to 1300° F., and, most preferably, from 1150° F. to 1250° F. for enhanced thermal efficiency. Spent shale in excess of 1400° F. should not be fed into the retort because it will decompose substantial quantities of carbonates in the oil shale. Heat carrier material below 1000° F. should not be fed into the retort, if possible, because fine removal problems are aggravated and heat carrier input requirements are increased because of the high attrition rates at high recycle ratios.

In the preferred embodiment, smaller oil shale particles that have been combusted provide the heat carrier material for the system. Sand can also be added as additional heat carrier material if necessary. If combustion of residual carbon (coke) on the retorted shale is insufficient to provide necessary heat for retorting, as might occur when lean oil shale is retorted and then combusted, some raw oil shale or some other hydrocarbon-containing material can be fed to combustion lift pipe 54 through inlet line 69 to supply supplementary heat for retorting.

The ratio of the solids flux flow rate of the heat carrier material (spent shale) being introduced into the retort by heat carrier line 31 to the solids flux flow rate of raw shale in lbs/ft$^2$ hr, fed into the retort by feed lines 22, 24 and 26 is in the range of from 0.5:1 to 10:1, and preferably, from 4:1 to 7:1 for more efficient retorting.

The influent rate of the raw oil shale particles and spent shale being fed into retort 28 is sufficient to mix the oil shale particles and spent shale together in the mixing chamber so that the hot spent shale directly contacts and heats the raw oil shale particles to substantially retort the raw oil shale particles in retort 28. The effluent product stream of hydrocarbons liberated during retorting is emitted as a gas, vapor or a mist and most likely, a mixture thereof. A series of vertical bars or other internals can also be positioned in the interior of retort 28 to promote mixing and heat transfer as well as to break up bubbles and reduce plugging that may result during retorting.

A fluidizing lift gas or motive gas, such as recycled light hydrocarbon gases which have been liberated from the oil shale during retorting and separated into a light gas fraction in a separator 32 such as a "fractionator," also referred to as a "distillation column" or "fractionating column," is injected by a lift gas injector or gas tube 34 into the bottom of retort 28 at a temperature between ambient temperature and 1000° F., preferably from 500° F. to 700° F., at a pressure from 30 to 100 psig, preferably at a maximum of 40 psig, and at a velocity of from 10 ft/sec to 200 ft/sec, preferably at a maximum of 100 ft/sec for better effectiveness. The velocity of the lift gas in the upper portion 30 of retort 28 is from 5 ft/sec to 200 ft/sec and preferably at a maximum at 100 ft/sec. A lift gas injection velocity of over 200 ft/sec should be avoided because it has a tendency to break apart the oil shale particles. A lift gas injection velocity below the minimum velocity indicated above will not provide enough lift for the oil shale particles.

The lift gas should not contain a sufficient amount of molecular oxygen to support combustion. In other words, a molecular oxygen, combustion-supporting gas, such as air, should be avoided as a lift gas in retort 28 because it could undesirably combust the liberated effluent product stream of shale oil. In the preferred embodiment, the lift gas contains hydrogen, methane, $C_2$ and other light hydrocarbons as well as at least 10% by volume carbon dioxide to effectively suppress carbonate decomposition in the retorting process. Desirably, the lift gas contains a maximum of 30% by volume carbon dioxide so as not to unduly cool the retort and aggravate carbonate decomposition. A lift gas containing a maximum of 20% by volume carbon dioxide is more effective. Steam can also be used as the lift gas.

Combustion of the raw oil shale particles and liberated hydrocarbons is prevented in retort 28 by preventing an amount of molecular oxygen sufficient to support combustion from entering the retort.

The injection pressure and flow rate of the lift gas into retort 28 is sufficient to enhance turbulent mixing of the raw oil shale particles and spent shale as well as to fluidize, entrain, propel, transport and convey the smaller oil shale particles from line 22 and spent shale from heat carrier line 30 upwardly through the retort into an overhead solids-containing collection vessel 36.

Larger size raw oil shale particles from large size oil shale feed line 26 fall downwardly by gravity flow to the bottom of retort 28 in countercurrent relationship to the upwardly flowing fluidized stream of smaller raw and spent oil shale particles. The upward stream of particles hinders the free fall of larger size particles for a sufficient residence time to allow the larger particles to be completely retorted in retort 28. The retort can also have perforated plates or other internals to help hinder the free fall of larger particles.

The larger of the medium size particles from intermediate line 24 can descend downwardly with the larger size particles from line 26. The smaller of the medium size particles from intermediate line 24 ascend upwardly with the smaller particles from line 22. In the illustrated embodiment, all the middle size particles flow upwardly with the smaller particles.

The solids residence time, lift gas velocity and pressure and correlated to allow retorting of substantially all the oil shale particles in retort 28 without substantial thermal cracking of the liberated hydrocarbons and substantially without carbonate decomposition.

The retorting temperature in retort 28 is in the range from 900° F. to 1200° F., preferably from 975° F. to 1050° F., and most preferably at 1025° F. for best results. Retorting temperatures above 1200° F. cause excessive carbonate decomposition, while retorting temperatures less than 1050° F. minimizes thermal cracking of the liberated hydrocarbons. The retorting pressure in retort 28 can be from 30 psig to 50 psig or higher. The retorting temperature and pressure in the retort are generally uniform, except in proximity to the feed inlets and outlets.

The gas residence time and solids residence time in the retort are a function of the length and capacity of the retort, as well as the retorting temperature, pressure and flow rate of fluidizing gas.

The bottom of the solids-containing vessel 36 is welded or otherwise secured to retort 28. In the illustrated embodiment the upper free-standing, unattached outlet 38 of retort 28 is spaced slightly below a conical baffle 40 whose apex is in axial alignment with the vertical axis of retort 28. The downwardly facing surfaces of conical baffle 40 direct and deflect the solids admixture as well as the lift gas and liberated hydrocarbons downwardly towards the lower portion of the solids-containing vessel 36.

The solids admixture moves downwardly by gravity flow in the lower portion of vessel 36 for a sufficient residence time to complete retorting of the raw oil shale particles. The downwardly converging, sloping bottom wall of vessel 36 facilitates downward flow of the solids admixture to solids discharge outlet 42. If desired, internals such as conical baffles can be staggered in the lower portion of vessel 36 to facilitate downward plug flow and minimize backflow of the solids admixture in the lower portion of vessel 36.

The effluent product stream of liberated hydrocarbons admixed with lift gas is withdrawn from the upper portion of the solids-containing vessel 36 through overhead line 41 and partially dedusted in a cyclone before being separated into fractions of light gases, light shale oil, middle shale oil and heavy shale oil in fractionating column 32. The light gases, light shale oil, middle shale oil and heavy shale oil are withdrawn from fractionating column 32 through light gas line 44, light oil line 46, middle oil line 48 and heavy oil line 50, respectively. Heavy shale oil has a boiling point over 600° F. to 800° F. Middle shale oil has a boiling point over 400° F. to 500° F. and light shale oil has a boiling point over 100° F.

The oil and gases from fractionating column 32 can be dedusted further in downstream dedusting equipment and upgraded in a catalytic cracker or hydrotreater or otherwise processed downstream. In the embodiment of FIG. 1, at least some of the light gases from gas line 44 are compressed, preheated and recycled into the lift gas injector 34 for use as part or all of the lift gas.

The retorted smaller oil shale particles and the heat carrier material which have been transferred upwardly into solids-containing vessel 36 are discharged through solids discharge outlet 42 at the bottom of the solids-containing vessel and are conveyed through a solids discharge pipe 52 by gravity flow into the bottom inlet end of an upright, dilute phase combustor lift pipe 54.

Retorted large oil shale particles from feed line 26 which have descended downwardly through retort 28 are withdrawn from the bottom of retort 28 through outlet 66. The retorted large particles in line 66 can be discarded or fed to the top of combustor lift pipe 56 by conveying means, such as a fluidizing gas or a conveyor to gravitate downwardly to the bottom of the lift pipe in countercurrent relationship to the upward flow of the smaller particles or can be fed to a separate combustor. The larger particles can also be crushed to a smaller size before being fed into the combustor lift pipe.

Air is injected into the bottom of combustor lift pipe 54 through air injector inlet 56 at a pressure and flow rate to fluidize, entrain, propel, convey and transfer the retorted smaller oil shale particles and heat carrier material from line 52 upwardly through combustor lift pipe 54 into an overhead combustor vessel 58. The combustion temperature in combustor lift pipe 54 is from 1000° F. to 1400° F. Residual carbon contained on the retorted oil shale particles is substantially combusted in combustor lift pipe 54. Combustion of the retorted oil shale particles is completed in combustor vessel 58. In combustor vessel 58, the retorted oil shale particles, heat carrier material and air are at a combustion temperature from 1000° F. to 1400° F.

Combustor lift pipe 54 extends upwardly into the interior of combustor vessel 58 and has an outlet 60 at its top end positioned slightly below a conical baffle 62. Baffle 62 has a downwardly diverging wall portion to deflect and direct the flow of combusted oil shale particles, heat carrier material and air into the lower portion of combustor vessel 58. The bottom of combustor vessel 64 slopes downwardly to facilitate the downward gravity flow of combusted oil shale particles and heat carrier material into the lower portion of the combustor vessel. The combusted oil shale particles and heat carrier material are discharged through an outlet in the bottom of combustor vessel 58 into heat carrier pipe 31 where they are conveyed by gravity flow into the bottom portion of retort 28.

The carbon contained in the retorted oil shale particles is burnt off mainly as carbon dioxide during combustion in combustor lift pipe 54 and combustor vessel 58 and together with the air and other products of combustion forms combustion off gases or flue gases which are withdrawn from the upper portion of combustor vessel 58 through combustion off gas line 64 and dedusted in a cyclone or electrostatic precipitator before being discharged to the atmosphere or processed further for energy recovery.

In the illustrated embodiment, the main body portions of the retort 28, solids-containing vessel 36, lift pipe 54 and combustor vessel 58 have a circular cross-section. Other cross-sectional configurations can also be used.

Figure 2:
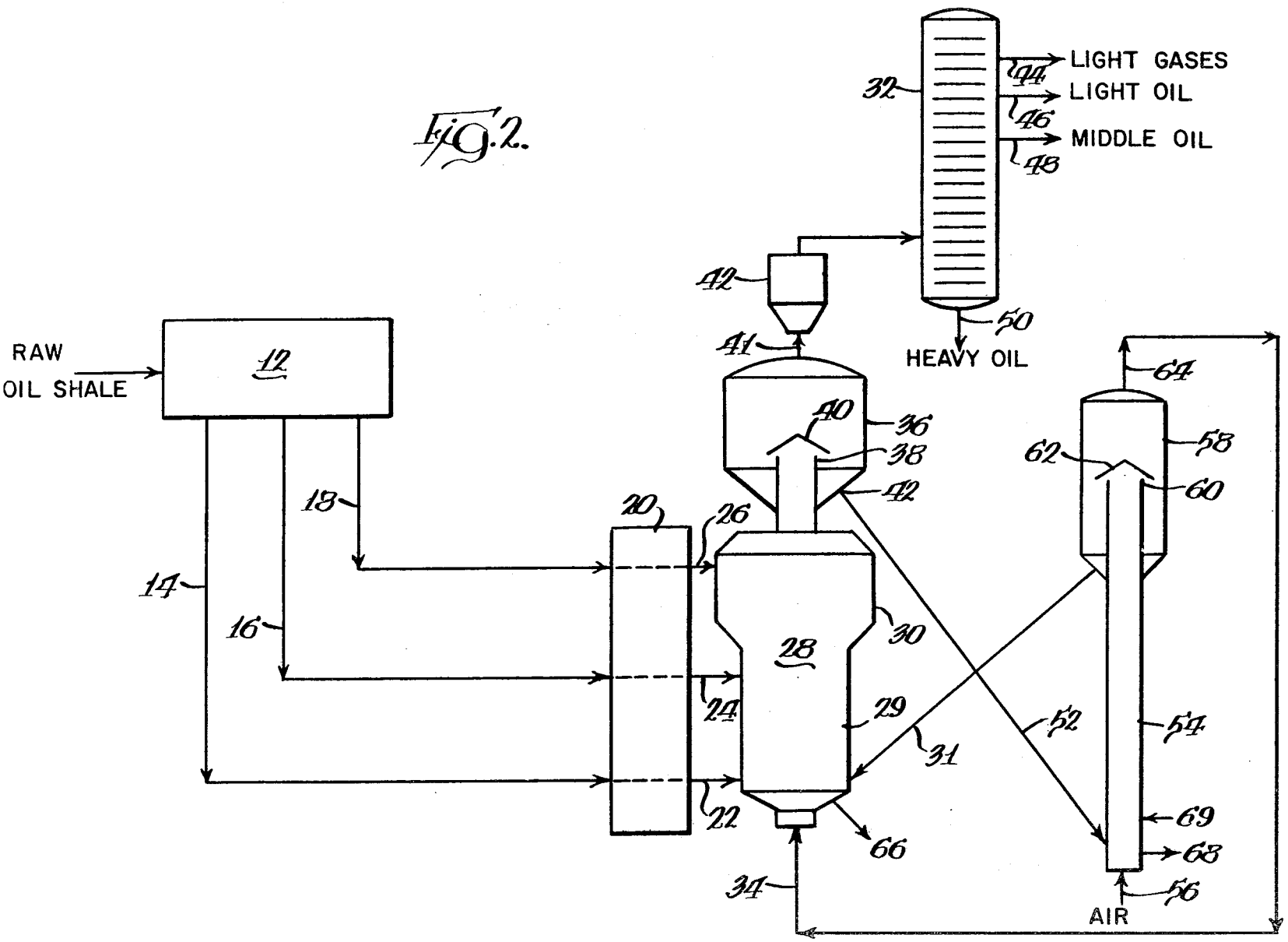
FIG. 2 is a schematic flow diagram of another fluid bed retorting system for carrying out a process in accordance with principles of the present invention.

In the embodiment of FIG. 2, the combustion off gases or flue gases withdrawn from combustor vessel 58 through overhead line 64 are recycled into lift gas injector 34 and used as the fluidizing lift gas or motive gas in retort 28 in lieu of light gases from fractionator 32. The combustion off gases can be dedusted before being recycled for use as the fluidizing gas.

Figure 3:
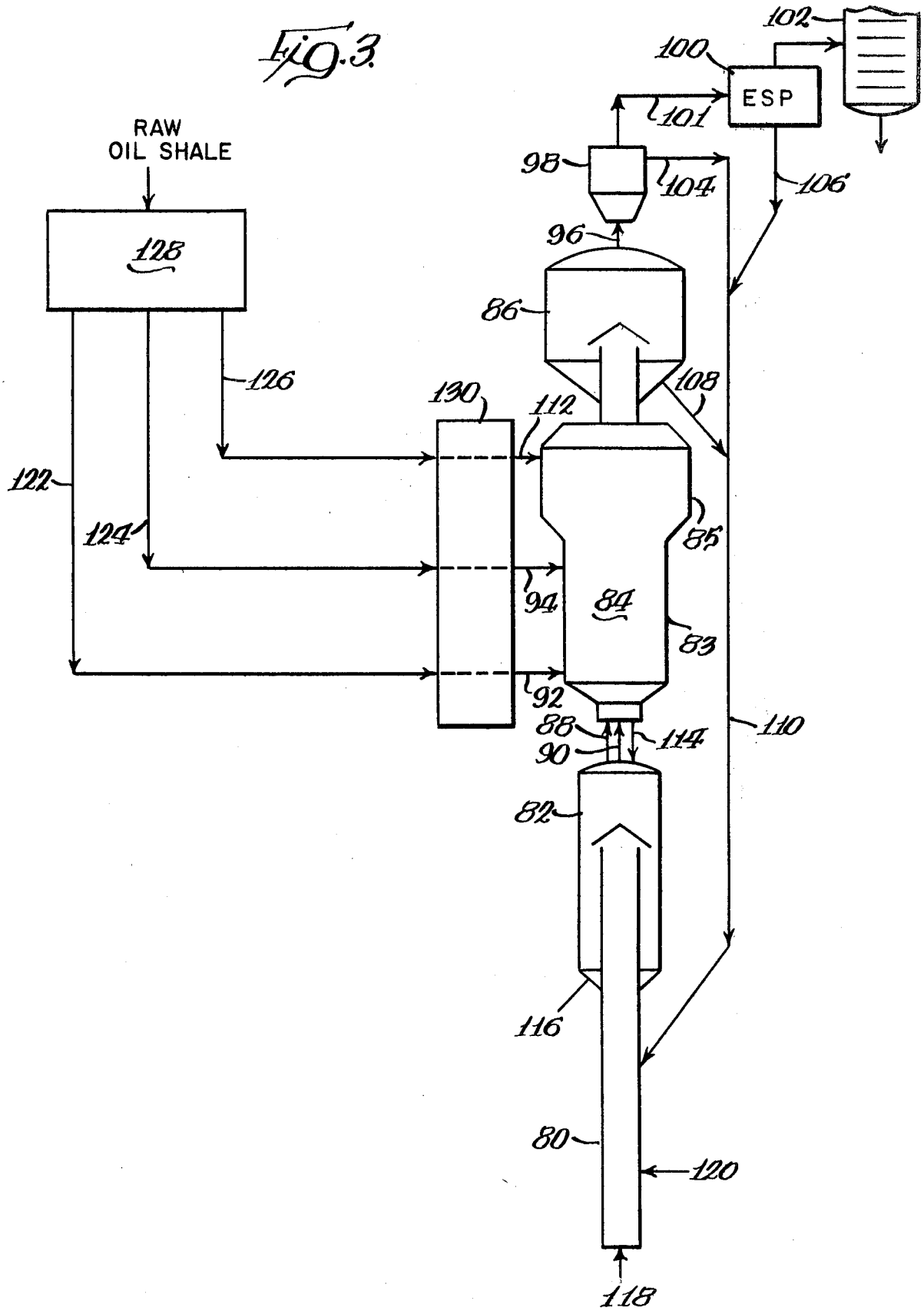
FIG. 3 is a schematic flow diagram of a further fluid bed retorting system for carrying out a process in accordance with principles of the present invention.

In the embodiment of FIG. 3, the upright dilute phase combustor lift pipe 80 and overhead combustor vessel 82, or alternatively a fluidized bed combustor, are aligned in vertical registration below fluid bed retort 84 and solids-containing vessel 86. Hot combustion off gases providing the fluidizing lift gas and smaller spent particles providing the solid heat carrier material from combustor vessel 82 or the fluidized bed combustor are fed into the bottom 83 of retort 84 via combustion off gas line 88 and heat carrier line 90, respectively, at a temperature from 1000° F. to 1400° F., preferably from 1100° F. to 1300° F., and most preferably at 1150° F. to 1250° F. for enhanced thermal efficiency. The hot combustion off gases also provide gaseous heat carrier material which fluidizes, entrains, mixes, retorts, carries, and transports the solid heat carrier material (spent shale) from line 90 and smaller raw oil shale particles from feed line 92, as well as at least some of the middle size raw oil particles from intermediate feed line 94, upwardly through the retort to overhead solids-containing vessel 86 in a manner similar to that indicated in the embodiment of FIG. 1.

Larger raw oil shale particles are fed through upper feed line 112 into the top portion 85 of retort 84. The larger particles are retorted as they descend downwardly through the rising flow of smaller particles into the bottom of retort 84. The larger, middle and smaller raw particles as well as the spent particles range in size similar to that indicated in the embodiment of FIG. 1.

Larger retorted particles are discharged from the bottom of retort 84 through large particle discharge line 114. Smaller particles are discharged from overhead vessel 86 through small particle discharge line 108.

Hydrocarbons liberated during retorting are withdrawn through overhead line 96 and partially dedusted in a cyclone 98 and in an optional electrostatic precipitator 100 via line 101 before being separated in a fractionating column 102 into light gases, light shale oil, middle shale oil and heavy shale oil. Dust removed from the effluent product stream of hydrocarbons in cyclone 98 and electrostatic precipitator 100 are discharged into dust lines 104 and 106, respectively. The dust from lines 104 and 106 and the smaller particles from line 108 are combined in conduit 110 and fed to the bottom portion of combustor lift pipe 80.

In the combustor life pipe 80, the dust and smaller particles are fluidized, entrained, combusted, conveyed and transported upwardly into an overhead combustor vessel 82 by an oxygen-containing, fluidizing, combustion lift gas injected into the bottom of lift pipe 80 by injector 118. The combusted particles and dust are carried out of vessel 82 through overhead line 90 into retort 84 where they serve as heat carrier material.

Oxygen is preferably used as the combustion lift gas instead of air in the embodiment of FIG. 3, so as not to contaminate the off gases of combustion with nitrogen, since the off gases also serve as the lift gas in retort 84. Steam or carbon dioxide could be added to the oxygen (combustion lift gas) as a diluent to avoid excessive combustion temperatures.

Larger retorted particles are discharged from the bottom of retort 84 through line 114 into the top of combustor vessel 82, or alternatively into the top of lift pipe 80 or a fluidized bed combustor, where they are combusted as they gravitate downwardly in countercurrent relationship to the smaller retorted particles until being discharged through outlet 116.

Some raw oil shale can be fed to lift pipe 80 through inlet line 120 to supply auxiliary heat for retorting when lean oil shale is being retorted.

As in the embodiment of FIG. 1, raw oil shale is crushed, sized and separated at crushing station 128 into small, medium and large particles which are fed into feed lines 122, 124 and 126, respectively. The small, medium and large particles are conveyed to a preheating station 130 where they are preheated to a temperature slightly below the retorting temperature of the oil shale. The preheated, small, medium and large size oil shale particles are then conveyed to retort 84 by preheated feed lines 92, 94 and 112, respectively, where they are retorted as described above.

Among the many advantages of the above retorting processes are:

1. Ability to effectively retort large and small oil shale particles.
2. Increased mass flow rates.
3. Higher retorting capacity.
4. Lower gas compression requirements.
5. Improved utilization of combustion gases.
6. Less crushing of oil shale.
7. Lower grinding costs.
8. Improved product yield.
9. Increased efficiency.
10. Greater throughput.

Although embodiments of this invention have been shown and described, it is to be understood that various modifications and substitutions, as well as rearrangement of parts and combination of process steps, can be made by those skilled in the art without departing from the novel spirit and scope of this invention.

What is claimed is:

1. A process for retorting solid hydrocarbon-containing material, comprising the steps of:

feeding a first stream of raw hydrocarbon-containing particles selected from the group consisting of oil shale, tar sands, coal, lignite, peat and uintaite, into a lower portion of a fluid bed retort;

feeding solid heat carrier material consisting of spent hydrocarbon-containing particles derived from said first stream into said lower portion of said fluid bed retort;

injecting a lift gas containing less than a sufficient amount of molecular oxygen to support combustion, into said lower portion of said fluid bed retort to fluidize, mix and transport said first stream and said spent hydrocarbon-containing particles substantially upwardly through an upper portion of said fluid bed retort into an overhead solids-containing collection vessel positioned substantially vertically above said fluid bed retort;

moving said first stream and said solid heat carrier material downwardly in said overhead vessel under the influence of gravity into a lower portion of said overhead vessel;

feeding a second stream of said raw hydrocarbon-containing particles into said upper portion of said fluid bed retort, said raw hydrocarbon-containing particles in said second stream being larger than said raw hydrocarbon-containing particles in said first stream;

moving said second stream downwardly in said fluid bed retort under the influence of gravity through and in countercurrent flow relationship to said first stream, into said lower portion of said fluid bed retort;

liberating oil and light hydrocarbon gases from said raw hydrocarbon-containing particles in said first and second streams in said fluid bed retort by heating said first and second streams to a retorting temperature in said fluid-bed retort with said solid heat carrier material;

substantially completing retorting of said first stream in said overhead vessel above said retort to liberate more oil and light hydrocarbon gases by heating said first stream at a retorting temperature with said solid heat carrier material in said overhead vessel;

withdrawing said second stream from the lower portion of said retort;

conveying said first stream and said solid heat carrier material by gravity flow from the lower portion of said overhead vessel to a combustor; and combusting said first stream with said solid heat carrier material in said combustor.

2. A process in accordance with claim 1 wherein said lift gas has an insufficient velocity to fluidize said second stream of raw hydrocarbon-containing particles.

3. A process in accordance with claim 1 wherein:

a third stream of hydrocarbon-containing particles is fed into said fluid bed retort at a location between said upper and lower portions; and said hydrocarbon-containing particles in said third stream are larger than said hydrocarbon-containing particles in said first stream and smaller than said hydrocarbon-containing particles in said second stream.

4. A process in accordance with claim 1 wherein said lift gas consists essentially of recycled light hydrocarbon gases emitted during retorting.

5. A process in accordance with claim 1 wherein said lift gas consists essentially of combustion off gases.

6. A process in accordance with claim 5, wherein said streams are combusted in a combustor located substantially vertically below said retort and said combustion gases are emitted from said combustor.

7. A process in accordance with claim 1 wherein said second stream is discharged from the lower portion of said retort and discarded.

8. A process in accordance with claim 1 wherein:

said first stream is introduced into a lower portion of said combustor and transported upwardly by said combustion lift gas into an upper portion of said combustor; and said second stream is transported from the lower portion of said retort and introduced into said upper portion of said combustor; and said second stream gravitates downwardly to said lower portion of said combustor in countercurrent relationship to said first stream.

9. A process in accordance with claim 1 wherein said first stream and said solid heat carrier material are deflected generally downwardly by conical baffles in said overhead vessel into said lower portion of said overhead vessel.

10. A process for retorting oil shale, comprising the steps of:

(a) feeding only small, raw oil shale particles ranging in size from at least one micron to less than 200 microns into a bottom portion of a generally upright fluid bed retort;

(b) feeding spent oil shale particles ranging in size from at least one micron to less than 200 microns into said bottom portion of said fluid bed retort at a temperature ranging from 1000° F. to 1400° F.;

(c) injecting a lift gas containing less than a sufficient amount of molecular oxygen to support combustion, into said bottom portion of said fluid bed retort;

(d) fluidizing, entraining, mixing and transporting said spent and small, oil shale particles, substantially upwardly with said lift gas through a top portion of said retort into an overhead solids-containing collection vessel positioned in vertical alignment above said fluid bed retort;

(e) feeding only larger, raw oil shale particles ranging in size from at least 2 mm to less than 10 mm into said top portion of said retort;

(f) gravitating said larger, raw oil shale particles substantially downwardly through said fluid bed retort in countercurrent relationship to said upward flow of spent and small, oil shale particles, into said bottom portion of said retort simultaneously with step (d);

(g) liberating shale oil and light hydrocarbon gases from said small and larger raw oil shale particles in said fluid bed retort by heating said small and larger raw oil shale particles to a retorting temperature ranging from 900° F. to 1200° F. in said fluid bed retort with said spent shale particles;

(h) substantially completing retorting of said small shale particles in said overhead vessel to liberate more shale oil and light hydrocarbon gases from said small shale particles by deflecting said spent and small shale particles generally downwardly with baffles into a lower portion of said overhead vessel;

(i) partially dedusting said shale oil and light hydrocarbon gases in a cyclone;

(j) transporting said retorted small shale particles and said spent shale particles outside of said fluid bed retort from said lower portion of said overhead vessel to a combustor lift pipe;

(k) transporting said larger oil shale particles from said lower portion of said fluid bed retort, separately and apart from said spent and small shale particles, to said combustor lift pipe; and (l) combusting said shale in said combustor lift pipe to form spent shale for step (b).

11. A process in accordance with claim 10, wherein intermediate raw oil shale particles ranging in size from at least 200 microns to less than 2 mm are fed into an intermediate portion of said fluid bed retort and intermixed with said spent oil shale particles to liberate shale oil and light hydrocarbon gases from said intermediate raw oil shale particles, said intermediate shale particles are transported from said retort to said combustor lift pipe and are combusted in said combustor lift pipe, and raw oil shale is crushed and separated into said small, intermediate and larger, raw oil shale particles before being fed to said retort.

12. A process in accordance with claim 10 wherein said raw oil shale particles are preheated to between ambient temperature and 700° F. before being fed into said fluid bed retort.

13. A process in accordance with claim 10 wherein said larger raw oil shale particles range in size from at least 3 mm to less than 6 mm.

14. A process in accordance with claim 10 wherein:

said spent and retorted small shale particles are fed into the bottom portion of said combustor lift pipe and are fluidized, combusted and transported generally upwardly through said combustor lift pipe by a combustion-sustaining lift gas consisting essentially of air;

said larger oil shale particles are discharged from the bottom portion of said retort into a top portion of said combustor lift pipe at a location generally below and in vertical registration with said bottom portion of said retort; and said larger oil shale particles are combusted and gravitate downwardly in said combustor lift in countercurrent flow to said small oil shale particles.

* * * * *

UNITED STATES PATENT OFFICE

CERTIFICATE OF CORRECTION

Patent No. 4,415,433 Dated November 15, 1983

Inventor(s) HOEKSTRA, GERALD B.

It is certified that error appears in the above-identified patent and that said Letters Patent are hereby corrected as shown below:

| Column | Lines | | | |
|---|---|---|---|---|
| 3 | 50 | "ae" | should read | --are-- |
| 13 | 13 | "fluid-bed" | should read | --fluid bed-- |
| 14 | 12-17 | Lines inadvertently indented. | | |

Signed and Sealed this

Eighth Day of May 1984

[SEAL]

Attest:

GERALD J. MOSSINGHOFF

Attesting Officer

Commissioner of Patents and Trademarks